United States Patent [19]

McAloon

[11] 4,089,758

[45] May 16, 1978

[54] ELECTROLYTIC PROCESS

[75] Inventor: Kevin Thomas McAloon, Runcorn, England

[73] Assignee: Imperial Chemical Industries Limited, London, England

[21] Appl. No.: 578,316

[22] Filed: May 16, 1975

[30] Foreign Application Priority Data

May 24, 1974 United Kingdom ..... 23275/74
May 24, 1974 United Kingdom ..... 23316/74

[51] Int. Cl.[2] ..... C25B 1/16; C25B 1/26; C25B 13/02

[52] U.S. Cl. ..... 204/98; 204/252; 204/266; 204/296; 260/2.5 R

[58] Field of Search ..... 204/98, 296, 252, 128, 204/266; 260/21, 2.5

[56] References Cited

U.S. PATENT DOCUMENTS

| | | | |
|---|---|---|---|
| 3,694,281 | 9/1972 | LeDuc | 204/296 X |
| 3,723,264 | 3/1973 | LeDuc et al. | 204/80 |
| 3,853,720 | 12/1974 | Korach | 204/98 |
| 3,853,721 | 12/1974 | Darlington et al. | 204/98 |

FOREIGN PATENT DOCUMENTS

| | | | |
|---|---|---|---|
| 289,848 | 5/1971 | Austria. | |
| 809,822 | 1/1974 | Belgium | 204/296 |
| 674,906 | 11/1963 | Canada | 204/52 |
| 2,401,942 | 1/1974 | Germany | 204/296 |
| 2,139,646 | 2/1972 | Germany | 204/296 |
| 1,081,046 | 8/1967 | United Kingdom | 204/296 |
| 1,410,313 | 10/1975 | United Kingdom | 204/296 |
| 1,355,373 | 6/1974 | United Kingdom. | |

*Primary Examiner*—Arthur C. Prescott
*Attorney, Agent, or Firm*—Cushman, Darby & Cushman

[57] ABSTRACT

An electrochemical cell having an anode and a cathode separated by a diaphragm wherein the diaphragm comprises a porous polymeric material containing units derived from tetrafluoroethylene, said material having a microstructure characterized by nodes interconnected by fibrils.

17 Claims, No Drawings

ELECTROLYTIC PROCESS

This invention relates to the use of porous diaphragms in electrochemical cells.

More particularly, the invention relates to the use of porous diaphragms based on tetrafluoroethylene polymers. Such diaphragms are especially suitable for use in cells electrolysing alkali metal chloride solutions.

In the specification of our UK Pat. No. 1,081,046 there is described a method of manufacturing porous diaphragms which comprises forming an aqueous slurry or dispersion of polytetrafluoroethylene and a solid particulate additive such as starch, adding an organic coagulating agent such as acetone to said dispersion and then drying the coagulated dispersion. An organic lubricant such as petroleum ether is then added to the dried coagulated material to serve as a processing aid when the material is being rolled into a sheet. On completion of the rolling operation the starch is removed to give the desired porous diaphragm. The lubricant can also be removed if required. The use of organic lubricants, however, makes it difficult to obtain porous polytetrafluoroethylene diaphragms with a high degree of reproducibility.

An improved method of manufacturing porous diaphragms in which the organic lubricant is replaced by water as the lubricant is described in the specification of our copending UK Application No. 5351/72. This method comprises preparing an aqueous slurry or dispersion comprising polytetrafluoroethylene and a removable solid particulate additive such as starch, thickening said aqueous slurry or dispersion to effect agglomeration of the solid particles therein, forming from the thickened slurry or dispersion a dough-like material containing sufficient water to serve as lubricant in a subsequent sheet forming operation, forming a sheet of desired thickness from said dough and removing solid particulate additive from the sheet to obtain the desired porosity.

As aforesaid, suitable removable solid particulate additives include starch, for example maize starch and/or potato starch, or a water-insoluble inorganic base or carbonate, for example calcium carbonate. If desired, these solid particulate additives may be removed from the diaphragm prior to introducing the diaphragm into the cell, for example, by soaking the diaphragm in an acid, preferably a mineral acid, e.g. hydrochloric acid. The diaphragm is then washed with water to remove the acid and assembled, whilst wet, into a cell. It is necessary to keep the diaphragm wet during assembly in order to prevent collapse of the pores and this leads to considerable difficulties in handling since the diaphragm is both extremely wet and extremely slippery (the latter being due to the inherent properties of the polytetrafluoroethylene). Further disadvantages arising from the use of pre-extracted diaphragms, include the difficulty of ensuring adequate tautness of the wet diaphragm whilst assembling in the cell unit, and the possibility of leakages occurring at the sealing gasket mounted along the wet edges of the diaphragm. Alternatively, the solid particulate additives may be removed from the diaphragm in situ in the cell, for example as described in our copending UK Application No. 34168/73, wherein the removal is carried out by filling the cell with working electrolyte, (e.g. an alkali metal chloride brine), and electrolysing the said electrolyte. This avoids the aforesaid disadvantages associated with pre-extracted diaphragms, but can lead to contamination of the cell liquor by oxidation products.

We have now found that the aforesaid disadvantages associated with the preparation, handling or use of porous diaphragms may be obviated or mitigated by the use of diaphragm materials based on porous polytetrafluoroethylene prepared in a particular way.

According to the present invention there is provided an electrochemical cell having an anode and a cathode separated by a diaphragm wherein the diaphragm comprises a porous polymeric material containing units derived from tetrafluoroethylene, said material having a microstructure characterised by nodes interconnected by fibrils.

The electrochemical cell is advantageously an electrolytic diaphragm cell for the electrolysis of an aqueous alkali metal chloride solution to give chlorine and an alkali metal hydroxide, e.g. chlorine and sodium hydroxide from sodium chloride brine.

According to another aspect of the present invention we provide a process for the electrolysis of aqueous solutions of ionisable chemical compounds in an electrochemical cell fitted with a diaphragm comprising the aforesaid porous polymeric material.

Yet another aspect of the present invention is a diaphragm for use in an electrochemical cell which comprises the aforesaid porous polymeric material and which further comprises a non-removable filler which is chemically resistant to the liquors in the cell and which is incorporated into said porous polymeric material at a stage subsequent to the preparation of the porous polymeric material.

The present invention however is applicable to other types of electrochemical cell, for example olefin oxidation cells, fuel cells and batteries.

The porous polymeric material comprising the diaphragm for use according to the present invention is as described and claimed in U.K. Pat. No. 1,355,373 (corresponding to South African Pat. No. 713287).

Said porous polymeric material is prepared by a process which comprises forming a shaped article of a tetrafluoroethylene polymer by extruding a paste of the polymer, expanding the said shaped article by stretching it in one or more directions, heating the polymer while in its stretched condition to a temperature above the melting point of the polymer, and maintaining the resultant porous article in its stretched condition while cooling. The porosity that is produced by expansion is retained for there is little or no coalescence or shrinking on releasing the cooled final article. The optimum heat treating temperature is in the range of 350° C to 370° C and the heating periods may range from about 5 seconds to about one hour.

The stretching is effected biaxially.

The porosity of the sintered sheet may be varied by introducing slight modifications into the manufacturing process; in particular an increase in stretch ratio gives rise to a product of high porosity. In addition, the temperature of heat treatment of the product is another important parameter as it is possible to enhance the extensibility of the tetrafluoroethylene polymer if the product is heat-treated to 327° C or greater. Since the porosity of the diaphragm can be varied by varying the processing conditions, diaphragms of different brine permeabilities can be obtained so that the porosity and therefore permeability of the diaphragm may be chosen according to diaphragm cell size and shape in order to gain efficient alkali halide conversion.

The porous polymeric material described in U.K. Pat. No. 1,355,373 may also incorporate fillers such as asbestos, carbon black, pigments, mica, silica, titanium dioxide, glass and potassium titanate. The fillers are mixed with the tetrafluoroethylene polymeric paste prior to extruding the polymer into a shaped article.

In the present invention said porous polymeric material is used in sheet form and we have found that good results can be obtained by treating the porous polytetrafluoroethylene sheets with a filler subsequent to their preparation by the stretching and heating technique described above. The filler to be used in accordance with the present invention is one which is non-removable, chemically resistant to the liquors in the cell and renders the polytetrafluoroethylene wettable.

One method of incorporating the filler into the porous polytetrafluoroethylene sheet is to immerse the sheet in a constantly agitated suspension of the filler in an organic liquid, for example an aliphatic alcohol such as iso-propyl alcohol.

An alternative method of incorporating the filler into the porous polytetrafluoroethylene sheet diaphragm is to impregnate the sheet with a hydrolysable precursor of the filler and then hydrolyse the precursor in situ in the sheet by the action of water or alkaline solution. The filler is obtained in hydrated form by this technique.

The filler may be an organic material which renders the diaphragm wettable but it is preferred to use an inorganic material, for example an inorganic oxide. The use of titanium dioxide or zirconium oxide is especially preferred.

The filler is selected so that its particle size is less than the largest pore size of the porous polytetrafluoroethylene sheet.

When the filler is incorporated by hydrolysis suitable precursors include tetra butyl titanate, titanium tetrachloride and zirconium oxychloride.

The introduction of fillers into the diaphragm gives rise to the formation of regularly shaped holes which is especially advantageous since the electrolytic process becomes more efficient due, partly, to the smooth and efficient disengagement of product gases i.e. chlorine and hydrogen from the face of the diaphragm, under operating conditions. In addition the presence of fillers modifies the strength characteristics of the diaphragm in that the dimensional stability of the diaphragm is improved under cell operating conditions so that the performance of the diaphragm remains constant for a longer period of time under cell conditions.

The diaphragms used in the process of the invention are highly porous, dimensionally stable, and are chemically resistant to the liquors in the cell.

The use of this diaphgram is especially advantageous in a chlor-alkali cell since unlike more conventional polytetrafluoroethylene diaphragms, this highly porous fibrillated diaphragm material can be amorphously locked. This material can also be joined to itself or to other materials, for example to metals used as anodes and cathodes such as titanium or iron, and to metals or cements used in cell bases, for example aluminium by the application of pressure and heat or by the use of either inorganic or organic binder resins, for example epoxy polyesters and polymethyl methacrylate. The ease with which complicated diaphragm shapes can be made therefore ensures the widespread adaptability of the diaphragm to numerous cells of different design.

Embodiments of the invention will now be described simply by way of example.

EXAMPLE 1

A 12.6 cm × 9.6 cm × 1 mm piece of porous polytetrafluoroethylene "GORE-TEX" Grade L10213 sheet (manufactured by W L Gore and Associates, Inc., U.S.A. in accordance with the process described in British Pat. No. 1,355,373 was successively treated with a 10% w/w aqueous solution of sodium hydroxide at ambient temperature for 2 hours, a 10% w/w aqueous solution of hydrochloric acid at ambient temperature for 2 hours, and a 10% w/w aqueous solution of sodium dihydrogen phosphate at the boiling point of the solution (about 100° C) for 1 hour.

The polytetrafluoroethylene sheet was mounted in a vertical diaphragm cell for the electrolysis of sodium chloride. The cell was fitted with a mild steel mesh cathode and had an anode/cathode gap of 9 mm. Brine was passed through the cell at a rate of 245 ml/hr from a head 9.5 cm high. This corresponded to a permeability of 0.215/hr. Applying current at 2 kA/m$^2$ gave rise to a voltage of 4.03 volts. The cell operated at a current efficiency of 95.2% corresponding to a salt conversion of 51%.

EXAMPLE 2

A 12.6 cm × 9.6 cm × 1 mm piece of porous polytetrafluoroethylene "GORE-TEX" Grade L10213 sheet (manufactured by W L Gore and Associates, Inc., U.S.A. in accordance with the process described in British Pat. No. 1,355,373) was successively treated with a 10% w/w aqueous solution of sodium hydroxide at ambient temperature for 2 hours, a 10% w/w aqueous solution of hydrochloric acid at ambient temperature for 2 hours, a 10% w/w aqueous solution of sodium dihydrogen phosphate at the boiling point of the solution (about 100° C) for 1 hour, and finally immersed in a constantly agitated 10% w/w suspension of titanium dioxide (of average particle size 0.2 micron) in isopropyl alcohol for 5 hours.

The polytetrafluoroethylene sheet impregnated with titanium dioxide was removed, washed with isopropyl alcohol to remove excess solid and then mounted in a vertical diaphragm cell for the electrolysis of sodium chloride. The cell was fitted with a mild steel mesh cathode and had an anode/cathode gap of 9 mm. Brine was passed through the cell at a rate of 315 ml/hr from a head 12.0 cm high. This corresponded to a permeability of 0.218/hr. Applying current at 2 kA/m$^2$ gave rise to a voltage of 3.26 volts. The cell operated at a current efficiency of 95.9% corresponding to a salt conversion of 48.5%.

EXAMPLE 3

A piece of porous polytetrafluoroethylene "GORE-TEX" sheet manufactured according to British Pat. No. 1,355,373 was presoaked in iso-propyl alcohol for approximately 30 minutes. The sheet was then treated with a solution of tetra butyl titanate in iso-propyl alcohol (15% v/v) for 30 minutes. The sheet was rolled and agitated intermittently during this period to ensure homogeneous diffusion of the tetra butyl titanate. Hydrolysis of the tetra butyl titanate to hydrated titania was effected by immersing the sheet in water for 30 minutes. The filled sheet next was treated with a 20% w/w solution of sodium hydroxide for 30 minutes. Finally, the sheet was soaked in iso-propyl alcohol prior to mounting in an electrolytic cell.

The cell was on load conditions for a period of 84 days and the following results were typical. For a 120 $cm^2$ cell at 2 $kA/m^2$ — cell voltage was 3.20 volts; permeability 0.385 $h^{-1}$; sodium hydroxide in catholyte 98.4 $gl^{-1}$; sodium chloride 181.4 $gl^{-1}$; current efficiency 94.5% corresponding to a salt conversion of 44.7%.

EXAMPLE 4

A piece of porous polytetrafluoroethylene "GORE-TEX" sheet manufactured according to British Pat. No. 1,355,373 was presoaked in iso-propyl alcohol. The sheet was then treated for 30 minutes in a solution comprising 100 parts of titanium tetrachloride to which was slowly added 100 parts of ammonium hydroxide solution in an ice bath, (0.88 v/v $NH_4OH$ was used). The sheet then was washed and soaked in isopropyl alcohol prior to mounting in an electrolytic diaphragm cell.

The cell was on load conditions for a period of 14 days and the following results were typical. For a 120 $cm^2$ cell at 2 $kA/m^2$ — cell voltage was 3.55 volts; permeability 0.57 $h^{-1}$; sodium hydroxide in catholyte 111 $gl^{-1}$; sodium chloride 157 $gl^{-1}$; current efficiency was 90.3% corresponding to a salt conversion of 50.8%.

EXAMPLE 5

A piece of porous polytetrafluoroethylene "GORE-TEX" sheet manufactured according to British Pat. No. 1,355,373 was presoaked in iso-propyl alcohol. The sheet then was treated for 30 minutes in a 15% w/v solution of zirconium oxychloride in 40 ml of water and 160 ml iso-propyl alcohol. Hydrolysis of the zirconium oxychloride and washing with water was effected over a period of 30 minutes. Finally, the sheet was soaked in isopropyl alcohol for 30 minutes prior to mounting in an electrolytic diaphragm cell.

The cell was put on load for 15 days. For a 120 $cm^2$ cell at 2 $kA/m^2$ a cell voltage of 3.60 volts and a permeability of 0.202 $h^{-1}$ were obtained.

What we claim is:

1. In a method of operating an electrolytic cell in which an aqueous electrolyte containing an ionizable compound is electrolyzed by means of an anode and a cathode the improvement comprising separating the anode and cathode by a diaphragm which comprises a porous polymeric material containing units derived from tetrafluoroethylene and having a microstructure that exhibits nodes interconnected together by fibrils, said material including a non-removable filler which is chemically resistant to the liquors in the cell and which renders the material wettable by the liquors in the cell.

2. A method as in claim 1 wherein the porous polymeric material has been made by forming a shaped article of a tetrafluoroethylene polymer by extruding a paste of the polymer, expanding the shaped article by stretching it in at least one direction, heating the polymer while in its stretched condition to a temperature above the melting point of the polymer, and maintaining the resultant porous article in its stretched condition while cooling.

3. An electrochemical cell for the electrolysis of aqueous solutions of ionizable compounds having an anode and a cathode which are separated by a diaphragm, wherein the diaphragm comprises a porous polymer material which contains units derived from tetrafluoroethylene and which has a microstructure that exhibits nodes interconnected together by fibrils, said material including a non-removable filler which is chemically resistant to the liquors in the cell and which renders the material wettable by the liquors in the cell.

4. An electrochemical cell as in claim 3 wherein the non-removable filler has been mixed with tetrafluoroethylene polymeric paste prior to the shaping of the porous polymeric material comprising the diaphragm.

5. An electrochemical cell as in claim 3 wherein the non-removable filler has been added to the porous polymeric tetrafluoroethylene material comprising the diaphragm after formation of porous polymeric material.

6. An electrochemical cell as in claim 5 wherein the non-removable filler has been added by immersing the porous polymeric material in a suspension of the filler in a liquid.

7. An electrochemical cell as in claim 5 wherein the non-removable filler has been added by impregnating the porous polymeric material with a hydrolysable precursor of the filler and then subjecting the precursor to hydrolysis by the action of water or an alkaline solution.

8. An electrochemical cell as in claim 3 wherein the non-removable filler is an inorganic oxide.

9. An electrochemical cell as in claim 8 wherein the oxide is titanium dioxide or zirconium oxide.

10. An electrochemical cell as in claim 3 wherein the porous polymeric material has been made by forming a shaped article of a tetrafluoroethylene polymer by extruding a paste of the polymer, expanding the shaped article by stretching it in at least one direction, heating the polymer while in its stretched condition to a temperature above the melting point of the polymer, and maintaining the resultant porous article in its stretched condition while cooling.

11. A diaphragm for use in electrochemical cells for the electrolysis of aqueous solutions of ionizable compounds comprising a porous polymeric material which contains units derived from tetrafluoroethylene and which has a microstructure that exhibits nodes interconnected by fibrils and which contains a non-removable filler chemically-resistant to the liquors in the cell and rendering the porous polymeric material wettable by the liquors, the non-removable filler having been added to the porous polymeric material after its formation.

12. A diaphragm as in claim 11 wherein the non-removable filler has been added by immersing the porous polymeric material in a suspension of the filler in a liquid.

13. A diaphragm as in claim 11 wherein the non-removable filler has been added by impregnating the porous polymeric material with a hydrolysable precursor of the filler and then subjecting the precursor to hydrolysis by the action of water or an alkaline solution.

14. A diaphragm as in claim 11 wherein the non-removable filler is an inorganic oxide.

15. A diaphragm as in claim 14 wherein the oxide is titanium dioxide or zirconium oxide.

16. A diaphragm as in claim 11 wherein the porous polymeric material has been made by forming a shaped article of a tetrafluoroethylene polymer by extruding a paste of the polymer, expanding the shaped article by stretching it in at least one direction, heating the polymer while in its stretched condition to a temperature above the melting point of the polymer, and maintaining the resultant porous article in its stretched condition while cooling.

17. A diaphragm as in claim 16 wherein the filler has a particle size less than the largest pore size of the porous material.

* * * * *